US009560910B2

(12) United States Patent
Hansen

(10) Patent No.: US 9,560,910 B2
(45) Date of Patent: Feb. 7, 2017

(54) DEVICE FOR CONNECTING A BELT OF A HEIGHT ADJUSTABLE FURNITURE PIECE

(71) Applicant: Kesseböhmer Produktions GmbH & Co. KG, Weilheim/Teck (DE)

(72) Inventor: Melf Hansen, Gondelsheim (DE)

(73) Assignee: KESSEBÖHMER PRODUKTIONS GMBH & CO. KG, Weilheim/Teck (DE)

( * ) Notice: Subject to any disclaimer, the term of this patent is extended or adjusted under 35 U.S.C. 154(b) by 68 days.

(21) Appl. No.: 14/617,438

(22) Filed: Feb. 9, 2015

(65) Prior Publication Data

US 2016/0227921 A1 Aug. 11, 2016

(51) Int. Cl.
*A47B 9/00* (2006.01)
*A47B 9/02* (2006.01)
*A47B 9/12* (2006.01)

(52) U.S. Cl.
CPC .. *A47B 9/02* (2013.01); *A47B 9/12* (2013.01)

(58) Field of Classification Search
CPC ..... A47B 9/02; A47B 9/12
USPC ..... 108/147; 248/297.11; 312/319.4
See application file for complete search history.

(56) References Cited

U.S. PATENT DOCUMENTS 3,905,311 A * 9/1975 Carpentier ..... A47B 23/046 108/136
5,400,721 A * 3/1995 Greene ..... A47B 9/02 108/147
5,682,825 A * 11/1997 Manner ..... A47B 9/02 108/144.11
5,715,759 A * 2/1998 Lee ..... A47B 9/12 108/147
6,062,148 A * 5/2000 Hodge ..... A47B 9/12 108/147
6,152,049 A * 11/2000 Schmidt ..... A47B 9/12 108/147

(Continued)

FOREIGN PATENT DOCUMENTS

DE 3329701 A1 3/1985
DE 90 06 486 U1 12/1991

(Continued)

OTHER PUBLICATIONS

Extended European Search Report dated Sep. 4, 2008 from related European Patent Application No. 07008776.2.

*Primary Examiner* — Hanh V Tran
(74) *Attorney, Agent, or Firm* — Hassan Abbas Shakir; Katten Muchin Rosenman LLP

(57) ABSTRACT

A height adjustable furniture piece includes a device for connecting a belt to the furniture piece. The device includes two support elements, each including a first extension member and a second extension member that is telescopically arranged with respect to the first extension member. The belt is fixed to the first extension member and a spring element connects the belt and the first extension member. The belt is deflected by pulleys such that a relative displacement between the first extension member and the second extension member of the first support element results in a synchronous relative displacement between the first extension member and the second extension member of the second support element. The spring element includes a spring force that assists lifting of the second extension member against the force of gravity.

5 Claims, 7 Drawing Sheets

(56) References Cited

U.S. PATENT DOCUMENTS

| | | | | |
|---|---|---|---|---|
| 6,378,446 | B1 * | 4/2002 | Long | A47B 9/02 108/147 |
| 9,038,549 | B1 * | 5/2015 | Zebarjad | A47B 9/02 108/147 |
| 9,232,855 | B2 * | 1/2016 | Ergun | A47B 9/02 |
| 2006/0130713 | A1 * | 6/2006 | Jones | A47B 9/00 108/106 |
| 2008/0250989 | A1 * | 10/2008 | Kozlowski | F16M 11/04 108/147 |
| 2010/0175592 | A1 * | 7/2010 | Looser | A47B 27/02 108/2 |
| 2011/0048291 | A1 * | 3/2011 | Long | A47B 9/02 108/147 |
| 2012/0187256 | A1 * | 7/2012 | Ergun | A47B 9/12 248/123.11 |
| 2012/0227642 | A1 * | 9/2012 | Sekikawa | A47B 9/10 108/147 |
| 2012/0248273 | A1 * | 10/2012 | Singer | F16M 11/18 248/297.11 |
| 2013/0256489 | A1 * | 10/2013 | Ergun | F16M 11/10 248/297.11 |
| 2014/0077050 | A1 * | 3/2014 | Huang | F16M 11/046 248/297.11 |

FOREIGN PATENT DOCUMENTS

| | | | |
|---|---|---|---|
| DE | 10216774 | A1 | 10/2003 |
| EP | 1987734 | A1 | 11/2008 |

* cited by examiner

PRIOR ART

DEVICE FOR CONNECTING A BELT OF A HEIGHT ADJUSTABLE FURNITURE PIECE

BACKGROUND OF THE INVENTION

1. Field of the Invention

The present invention relates to a device for connecting a belt of a height adjustable furniture piece and, in particular, it relates to a device for connecting a belt of a height adjustable furniture piece to a spring element for supporting a lifting operation of the movable part of the furniture piece against the force of gravity.

2. Discussion of the Related Art

From prior art, there is known a furniture piece with a device for a movement synchronization of supporting elements. FIG. 1 shows an example for a known furniture piece according to EP 1 987 734 A1 with a device for movement synchronization of supporting elements. In particular, EP 1 987 734 A1 discloses a device including two support elements 1,2, each support element comprising a first extension member 4 and a second extension member 5, wherein the first extension member 4 and the second extension member 5 are arranged displaceable with respect to each other in a telescopically manner. Furthermore, the device includes at least a first belt 6 with one end of which being fixed to the first extension member 4 of the first support element 1 and the other end of which being fixed at the first extension member 4 of the second support element 2. A deflection of the first belt 6 by means of pulleys 8,9,10 is carried out in a manner, such that a relative displacement between the first extension member 4 and the second extension member 5 of the first support element 1 results in a synchronous displacement between the first extension member 4 and the second extension member 5 of the second support element 2, relative to each other. Furthermore, the belt 6 is a steel belt and each of the pulleys 8, 9, 10, 11, 12, 13 are supported by only one ball bearing and the admissible tilt of the ball bearing supports centering the steel belt 6, 7.

Furthermore, there is known a furniture piece with a device for movement synchronization of supporting elements as shown in FIG. 2. In comparison with the prior art mentioned above, the device shown in FIG. 2 discloses a spring element 30 connected to a belt 6 to assist lifting of the movable part of the furniture piece against force of gravity.

The disadvantage of the connection between the spring element 30 and the belt 6 as shown in FIG. 2 is subsequently explained:

As shown in FIG. 2, a rope 40 is provided between the spring element 30 and the belt 6. If the movable part of the furniture piece is lifted, due to the kinematical interaction of the belt 6 and the pulleys 8, 9, 10, 11, 12, 13, the rope 40 which connects the spring element 30 and the belt 6 is moved. Thereby, the point of connection connecting the rope 60 and the belt 6 is moved with the belt 6 as well. Thereby, the spring element 30 is tensioned and the spring force acts against the force of gravity of the movable part of the furniture piece. Because of the pulley block (interaction of belt 6 and pulleys 8, 9, 10, 11, 12, 13), the moving distance of the point connecting the rope 40 and the belt 6 is twice as large as the moving distance of the movable part of the furniture piece while moving up or down. Therefore, the rope 40 needs a sufficient dimension in length. Furthermore, there is a problem since the spring rate of the spring element 30 is not constant and changes as a function of the height of the movable part of the furniture piece. Furthermore, the possible elongation of the spring element 30 has to be sufficient for covering the entire height change of the movable part of the furniture piece. Furthermore, as a further disadvantage since the belts 6 are heavy and expensive, the belts 6 are quite long in such a construction as shown in FIG. 2.

SUMMARY OF THE INVENTION

Therefore, the object of the invention is to provide a device for connecting a belt of a height adjustable furniture piece to a spring element with a reduced number of parts and to reduce manufacturing costs.

Further, it is an object to provide a height adjustable furniture piece having an improved means of adjusting its height.

At least one object mentioned above is achieved by a device for connecting a belt of a height adjustable furniture piece to a spring element according to claim 1 of the present invention. Advantageous developments are subject of the dependent claims.

It is important to note for the following explanations that they always refer to a furniture piece column or a furniture piece. A furniture piece column also includes structures that are provided, for example, on cupboards and/or on the hinges thereof, in order to enable an automatic adjustment of these components. The same applies, for example, for chairs and components of beds or bed frames.

Furthermore, it is possible that a height adjustable furniture piece according to the invention comprises at least one gas pressure spring which assists in acting against force of gravity of the movable part of the furniture piece.

There are several advantages resulting from the arrangement that the belt is connected to the spring element wherein the spring element is connected to the first extension member. By means of this arrangement, the number of parts is reduced, and therefore, manufacturing costs are reduced. As a further advantage, a portion of the belt which e.g. is a steel belt can be replaced by the construction according to the invention. Therefore, material costs and weight can be saved.

The problem that the spring rate of the spring element is not constant can be solved by means of providing a conversion mechanism between the spring element and belt. Thereby, the spring force acting against the force of gravity of the movable part of the furniture piece is converted to be constant, independent from the height of the movable part of the furniture piece.

By means of providing pulleys for guiding the rope which is fixed to the belt can be ensured that the rope pulls the belt always at a position straight under the belt. Thereby, the belt is prevented from becoming folded. Further, it is advantageous that a rigid sheet is fixed to the belt for being guided by the pulleys.

Furthermore, a further development according to the invention comprises a device for adjusting the pretension of the spring force. Thereby, the furniture piece can be adapted to different loads acting on the movable part of the furniture piece.

BRIEF DESCRIPTION OF THE DRAWINGS

Details, further advantages and developments of the invention will be described in more detail on the basis of the following embodiments, referring to the attached illustrations.

DETAILED DESCRIPTION OF THE INVENTION

Figure 1:
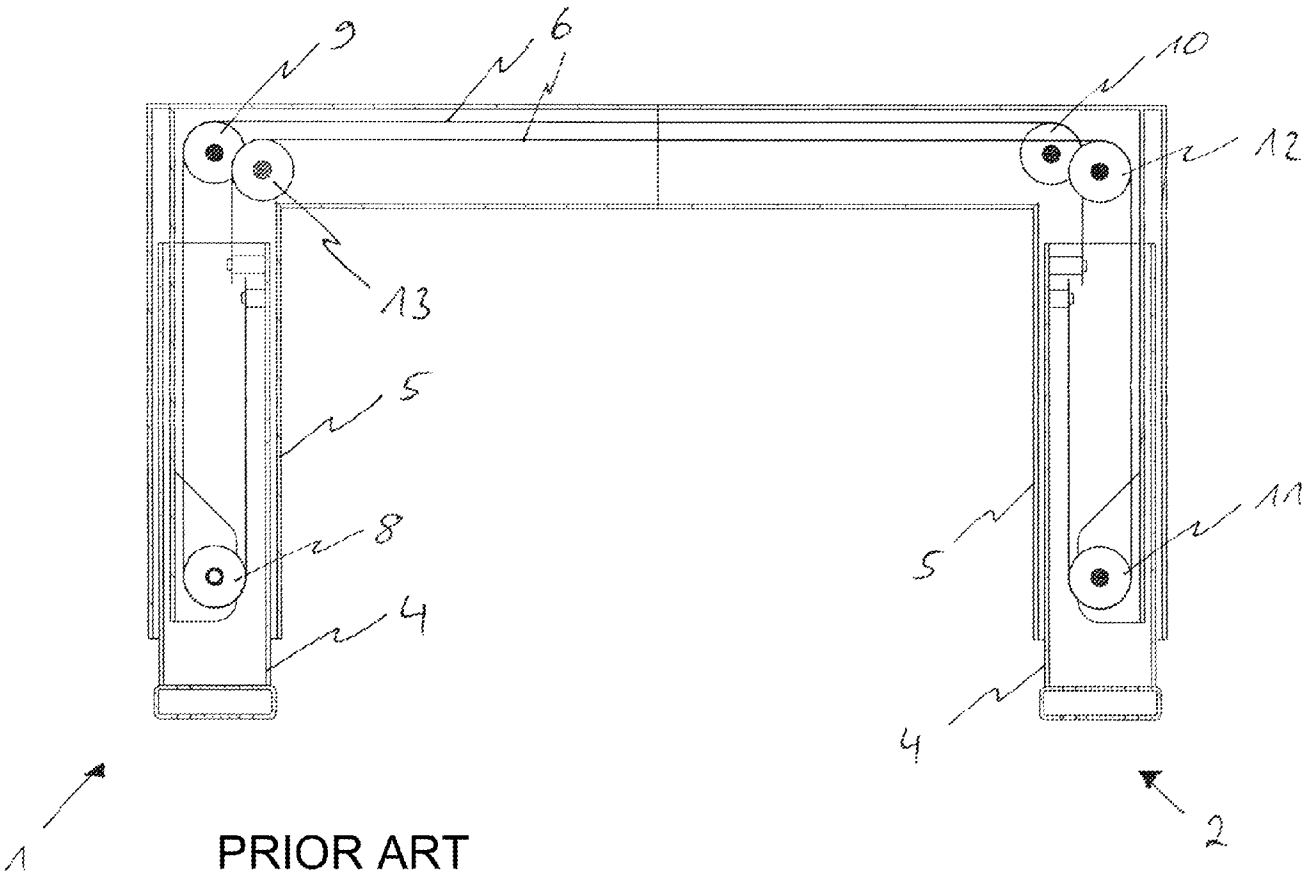
Fig. 1 PRIOR ART
FIG. 1 shows a height-adjustable table without a spring element as known from prior art.

FIG. 1 shows an example for a height-adjustable furniture piece with two support elements 1 and 2, further comprising first extension members 4 standing on the ground. The furniture piece comprises a movable upper part including second extension members 5. Furthermore, pulleys 8, 9, 10, 11, 12, 13 are connected to the movable upper part. The furniture piece further comprises two belts 6 the ends of which are fixed to the first extension members 4. Resulting from the kinematics of the belts 6 and the pulleys 8, 9, 10, 11, 12, 13, a change in height of the movable part of the furniture piece is synchronised in both of the support elements 1 and 2.

Figure 2:
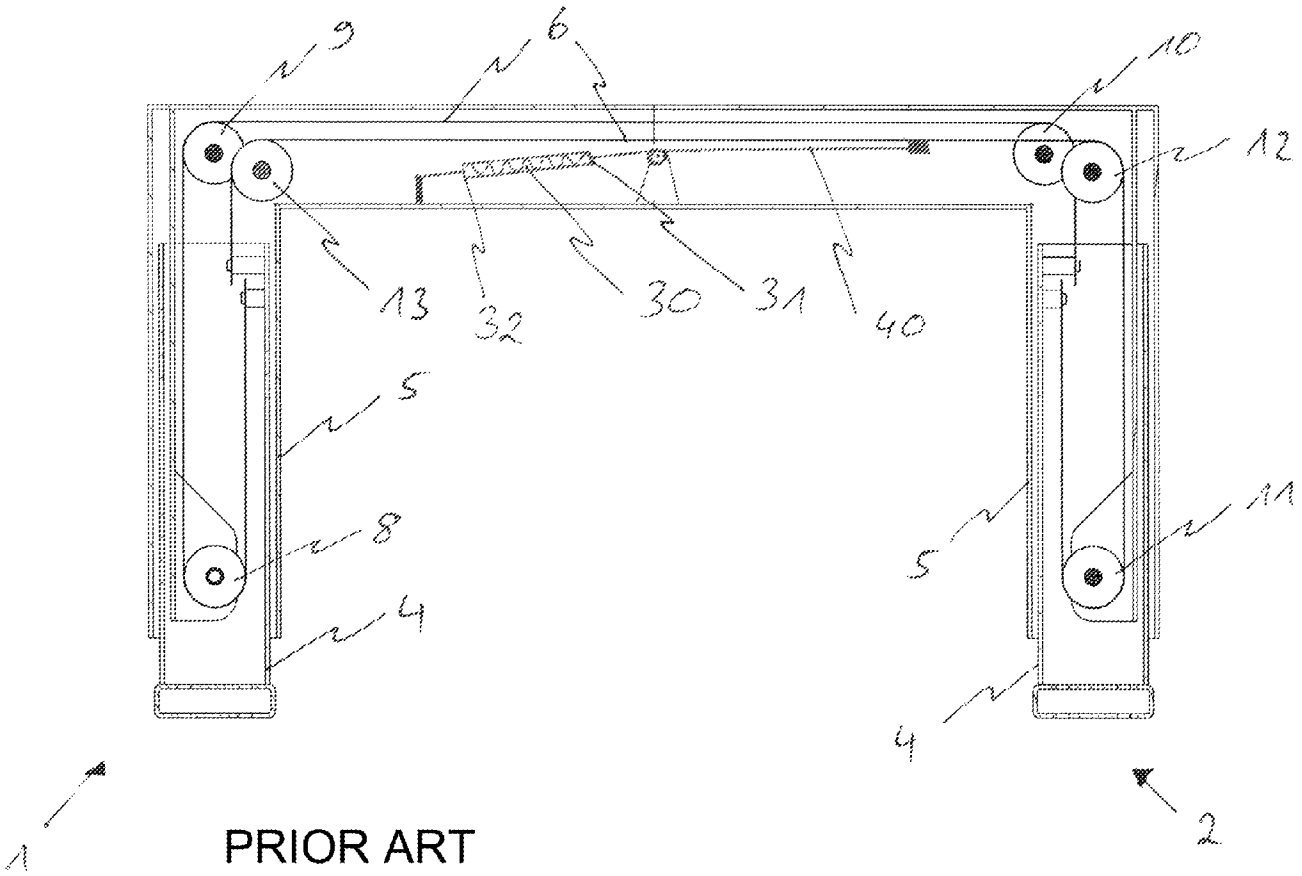
Fig. 2 PRIOR ART
FIG. 2 shows a height-adjustable table with a spring element as known from prior art.

FIG. 2 shows, as an example, the furniture piece from FIG. 1, further comprising a spring element 30 one end 32 of which is fixed to the movable part of the furniture piece, and the other end 31 of which is fixed to the belt 6. The spring force of the spring element 30 acts against a downward-movement of the movable part of the furniture piece, which means it acts against the force of gravity of the movable part of the furniture piece.

Figure 3:
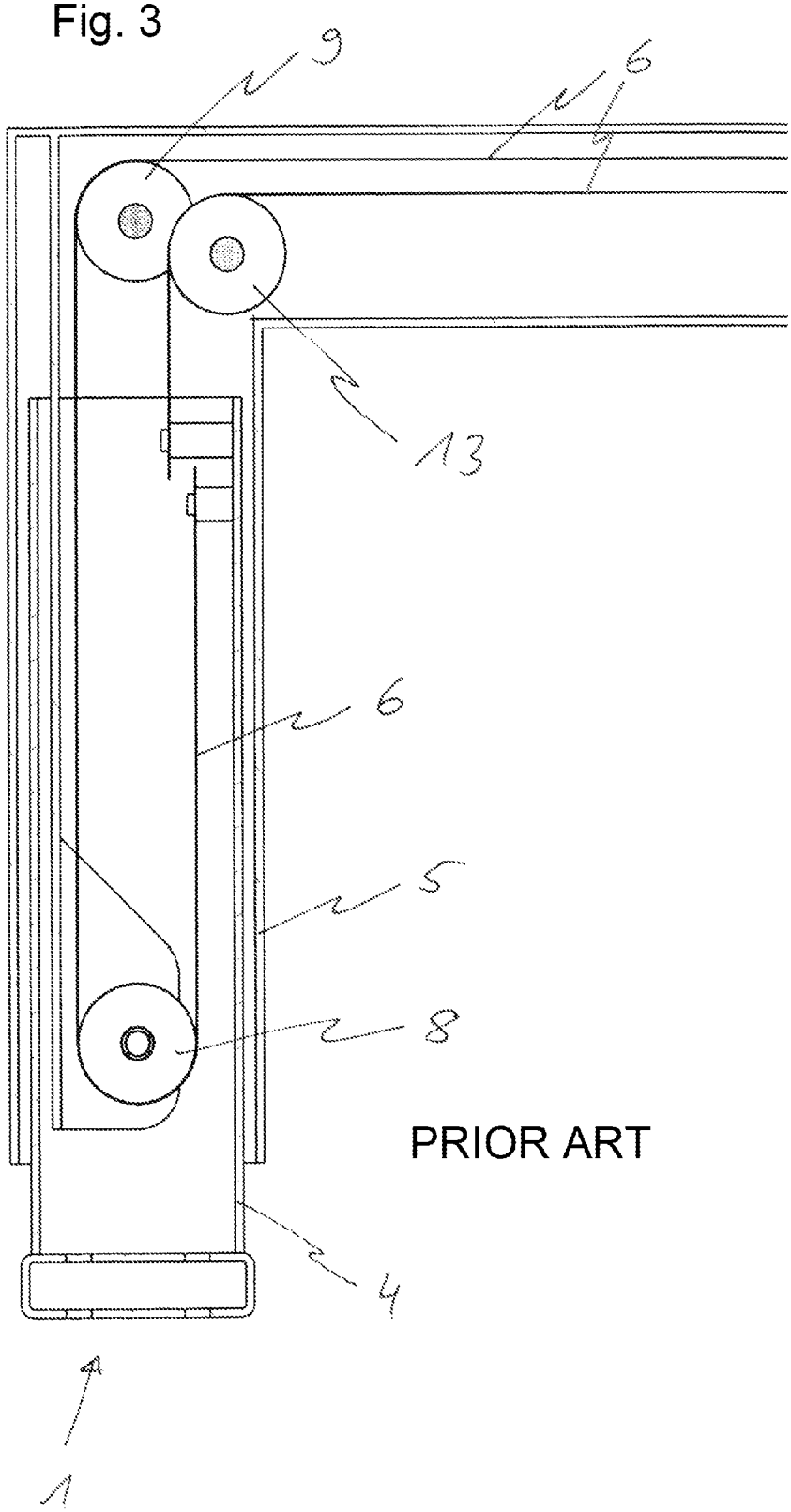
FIG. 3 shows a height-adjustable support element of a furniture piece as known from prior art.

FIG. 3 shows the first support element 1 shown in FIG. 2 in detail. The pulley 8 is rotatably supported on the movable part of the furniture piece and guides the belt 6 towards the pulley 9. Another belt 6 is guided by pulley 13. Further, each belt 6 is fixed at the first extension member 4 of the first support element 1.

Figure 4:
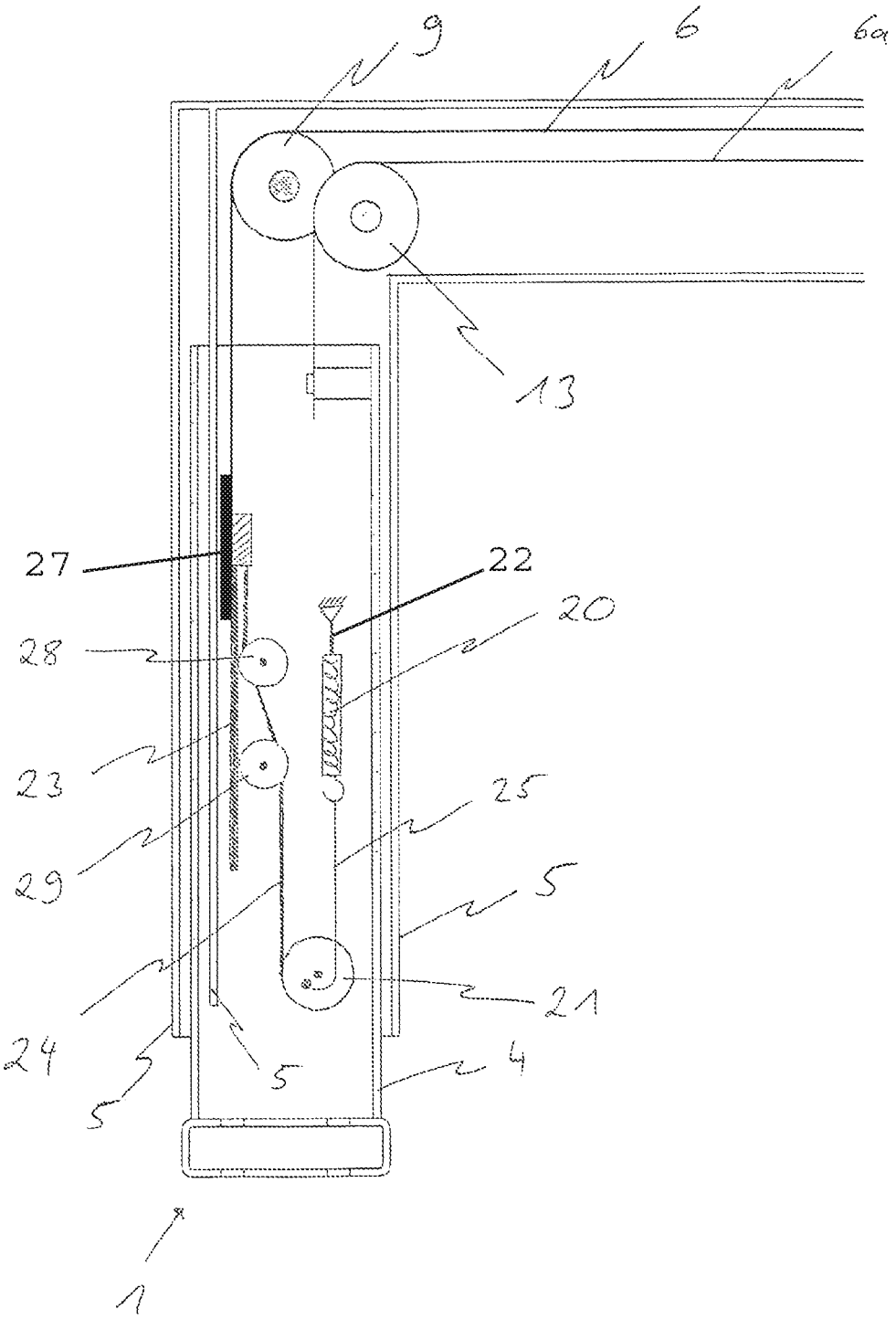
FIG. 4 shows a schematically view of an height-adjustable support element of a furniture piece according to the invention.

FIG. 4 shows a part of a height adjustable furniture piece, especially a first support element 1 according to the invention. The remaining parts of the furniture piece which are not shown in FIG. 4 correspond to FIG. 1. In comparison with the support element 1 shown in FIG. 3, the belt 6 shown in FIG. 4 is connected to a rigid sheet 23. The rigid sheet 23 is guided by pulleys 28, 29 which are fixed to the second extension member 5 which is part of the movable part of a furniture piece. A rope 24 is fixed to one end of the belt 6 and guided by the pulleys 28, 29. Further, the other end of the rope 24 is fixed to a conversion mechanism 21 which is rotatably supported on the second extension member 5 which is part of the movable part of the furniture piece. A further rope 25 is fixed at its one end to the conversion mechanism 21. The other end of the rope 25 is fixed to a spring element 20 which in turn is fixed to the first extension member 4 standing on the ground. Further, it is possible that a device 22 for adjusting the pretension of the spring element 20 is provided between the spring element 20 and the first extension member 4.

Furthermore, the construction for movement synchronisation of two support elements as shown in FIGS. 1 and 2 requires that each of the two belts 6 having the same length. Otherwise, the furniture piece cannot move up and down since the kinematical system is blocking This condition (requirement that each of the belt 6 has the same length) is also valid for the construction as shown in FIG. 4, in the figurative sense. However, in the construction as shown in FIG. 4, in comparison with the construction as shown in FIG. 3, a portion of the belt 6 is replaced by the arrangement, in the following named as functional chain consisting of spring element 20, rope 25, conversion mechanism 21 and rope 24. However, in case of moving the movable part of the furniture piece up and down, the spring element 20 changes its length. And further, if the conversion mechanism 21 is rotating, the change of the lengths of the ropes 24 and 25 is not equal. According to that, the functional chain changes its length when moving the movable part of the furniture piece up and down.

However, as mentioned above, the construction as shown in FIG. 4 comprises the second belt **6*a* which is arranged as shown in FIGS. 1 and 2. And further, the second belt 6*a* does not change its length in case of moving the movable part of the furniture piece. Therefore, there would be a problem with a construction as shown in FIG. 4 in case of moving the movable part of the furniture piece, since the functional chain changes its length unlike the second belt 6*a* which does not change its length. Therefore, the change in length of the functional chain has to be compensated. For compensation of the change in length of the functional chain there are provided two pulleys 28 and 29, which are guiding the rope 24 as well as the rigid sheet 23. By means of the kinematical system of the pulleys 28 and 29 which are guiding the rope 24 and the rigid sheet 23 the length of the functional chain (consisting of spring element 20, rope 25, conversion mechanism 21 and rope 24**) can be adapted during moving the movable part of the furniture piece.

Figure 5:
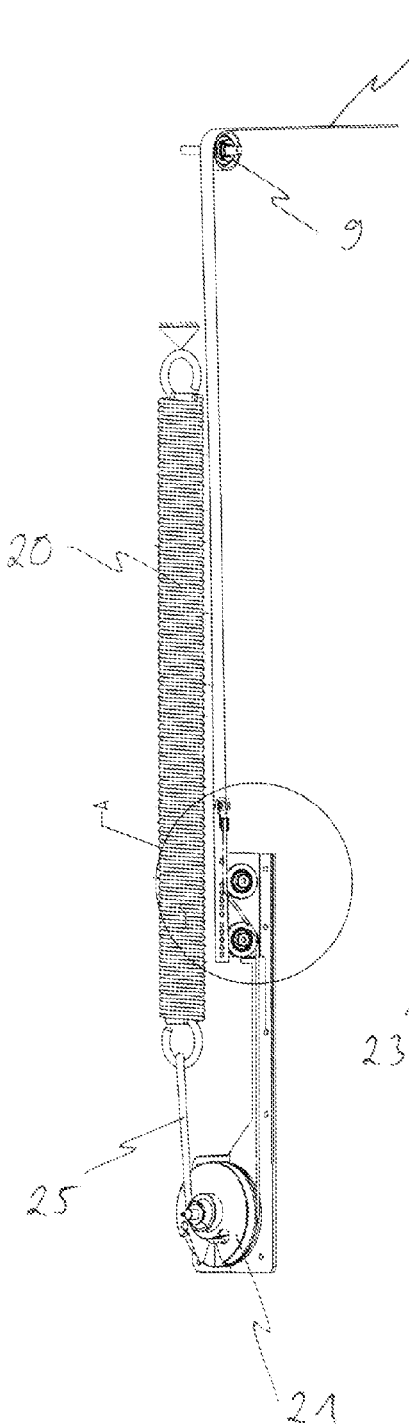
FIG. 5 shows a detailed view of an height-adjustable support element of a furniture piece according to the invention.

FIG. 5 shows a constructional implementation of a part of the elements described in FIG. 4. Further, FIG. 5 shows that the rope 25 is wound up on a helical part of the conversion mechanism 21. Further, the rope 24 can be fixed to the belt 6 by clenching.

As a further embodiment, it is possible that a further small rigid sheet is fixed to the belt 6 together with the rope 24, wherein the belt 6 is sandwiched between rope 24 and the further small rigid sheet 27.

Figure 6:
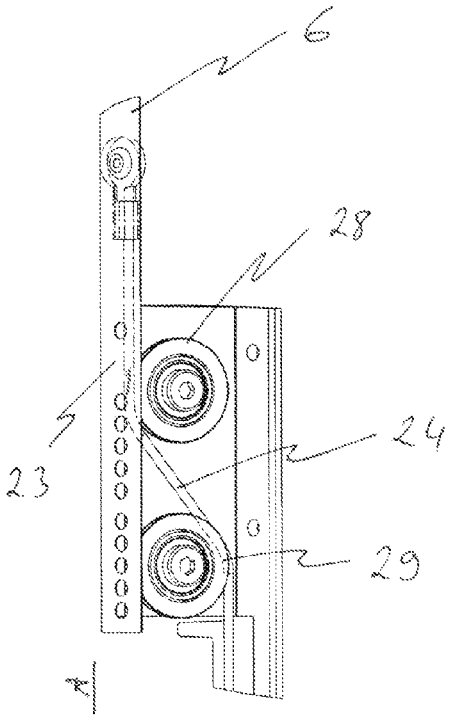
FIG. 6 shows an increased view of the details indicated in FIG. 5 with "A"

FIG. 6 shows the details of FIG. 5 indicated with "A", wherein the pulleys 28 and 29 correspond to the pulleys 28 and 29 shown in FIG. 4.

Figure 7:
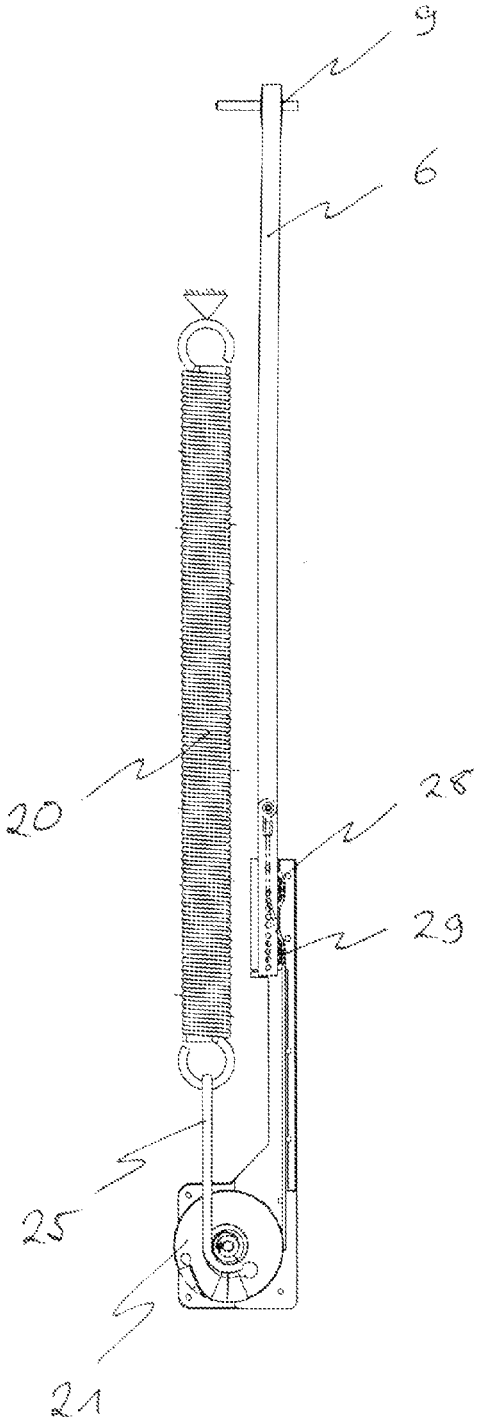
FIG. 7 shows a rotated view of the support element shown in FIG. 5.
Figure 8:
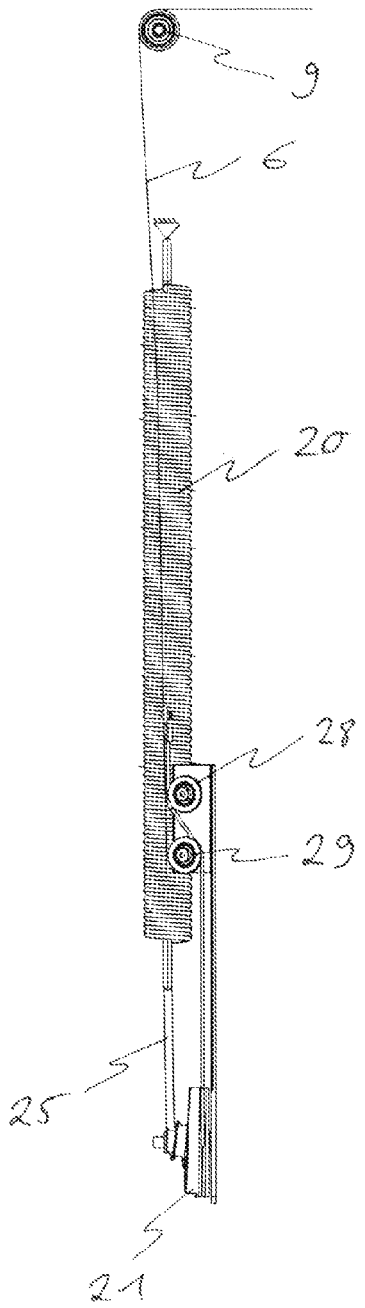
FIG. 8 shows a rotated view of FIG. 5.

FIG. 7 and FIG. 8 are rotated views of FIG. 5. It can be seen from FIGS. 7 and 8 that the rope 25 is wound up on the helical part of the conversion mechanism 21.

What is claimed is:

1. A device for connecting a belt of a height adjustable furniture piece, the device comprising:

a first support element and at least a second support element, each of the support elements comprising a first extension member, and a second extension member being telescopically arranged with respect to the first extension member;

the belt being fixed to the first extension member of the second support element; and a spring element, the belt being connected to the spring element, the spring element being connected to the first extension member of the first support element;

a conversion mechanism provided between the spring element and the belt;

a rope connecting the belt with the conversion mechanism; and a rigid sheet fixed to the belt and guided by pulleys;

wherein the belt is deflected by pulleys such that a relative displacement between the first extension member and the second extension member of the first support element results in a synchronous relative displacement between the first extension member and the second extension member of the second support element; and wherein the spring element comprises a spring force that assists lifting of the second extension member against the force of gravity;

wherein the conversion mechanism is fixed to the second extension member of the first support element;

wherein the rope is guided by the pulleys, the pulleys being fixed to the second extension member of the first support element.

2. The device according to claim 1, further comprising a pre-tensioning device for adjusting the pretension of the spring element.

3. A device for connecting a belt of a height adjustable furniture piece, the device comprising:

a first support element and at least a second support element, each of the support elements comprising a first extension member, and a second extension member being telescopically arranged with respect to the first extension member;

the belt being fixed to the first extension member of the second support element; and a spring element, the belt being connected to the spring element, the spring element being connected to the first extension member of the first support element;

wherein the belt is deflected by pulleys such that a relative displacement between the first extension member and the second extension member of the first support element results in a synchronous relative displacement between the first extension member and the second extension member of the second support element; and wherein the spring element comprises a spring force that assists lifting of the second extension member against the force of gravity;

a first small rigid sheet, the first small rigid sheet being fixed to the belt together with a rope, wherein the belt is sandwiched between the rope and a second small rigid sheet.

4. A height adjustable furniture piece, the furniture piece comprising:

a device for connecting a belt to the furniture piece, the device comprising a first support element and at least a second support element, each of the support elements comprising a first extension member, and a second extension member being telescopically arranged with respect to the first extension member;

the belt being fixed to the first extension member of the second support element; and a spring element, the belt being connected to the spring element, the spring element being connected to the first extension member of the first support element;

wherein the belt is deflected by pulleys such that a relative displacement between the first extension member and the second extension member of the first support element results in a synchronous relative displacement between the first extension member and the second extension member of the second support element; and wherein the spring element comprises a spring force that assists lifting of the second extension member against the force of gravity;

a first small rigid sheet, the first small rigid sheet being fixed to the belt together with a rope, wherein the belt is sandwiched between the rope and a second small rigid sheet.

5. A height adjustable furniture piece, the furniture piece comprising:

a device for connecting a belt to the furniture piece, the device comprising a first support element and at least a second support element, each of the support elements comprising a first extension member, and a second extension member being telescopically arranged with respect to the first extension member;

the belt being fixed to the first extension member of the second support element; and a spring element, the belt being connected to the spring element, the spring element being connected to the first extension member of the first support element;

a conversion mechanism provided between the spring element and the belt;

a rope connecting the belt with the conversion mechanism; and a rigid sheet fixed to the belt and guided by pulleys;

wherein the belt is deflected by the pulleys such that a relative displacement between the first extension member and the second extension member of the first support element results in a synchronous relative displacement between the first extension member and the second extension member of the second support element; and wherein the spring element comprises a spring force that assists lifting of the second extension member against the force of gravity;

wherein the conversion mechanism is fixed to the second extension member of the first support element;

wherein the rope is guided by the pulleys, the pulleys being fixed to the second extension member of the first support element.

* * * * *